US007048314B2

(12) United States Patent
Spurr

(10) Patent No.: US 7,048,314 B2
(45) Date of Patent: May 23, 2006

(54) POWER OPERABLE LATCH THAT RELATCHES IN THE EVENT OF MOTOR FAILURE

(75) Inventor: Nigel Victor Spurr, Shirley (GB)

(73) Assignee: ArvinMeritor Light Vehicle Systems (UK) Ltd., Birmingham (GB)

( * ) Notice: Subject to any disclaimer, the term of this patent is extended or adjusted under 35 U.S.C. 154(b) by 140 days.

(21) Appl. No.: 10/803,553

(22) Filed: Mar. 18, 2004

(65) Prior Publication Data

US 2004/0201226 A1 Oct. 14, 2004

(30) Foreign Application Priority Data

Mar. 22, 2003 (GB) ..... 0306671.9

(51) Int. Cl.
*E05C 3/06* (2006.01)

(52) U.S. Cl. ..... 292/216; 70/279.1; 292/201

(58) Field of Classification Search ..... 292/216, 292/201; 70/279.1, 282
See application file for complete search history.

(56) References Cited

U.S. PATENT DOCUMENTS

| | | | | |
|---|---|---|---|---|
| 4,624,491 | A | 11/1986 | Vincent | |
| 4,763,936 | A | 8/1988 | Rogakos et al. | |
| 5,020,838 | A * | 6/1991 | Fukumoto | 292/201 |
| 6,076,868 | A | 6/2000 | Roger, Jr. et al. | |
| 6,386,599 | B1 * | 5/2002 | Chevalier | 292/201 |
| 6,431,619 | B1 | 8/2002 | Fisher et al. | |
| 6,536,814 | B1 * | 3/2003 | Kachouh | 292/216 |
| 6,565,131 | B1 * | 5/2003 | Roos | 292/201 |
| 6,568,720 | B1 | 5/2003 | Szablewski | |
| 6,712,407 | B1 * | 3/2004 | Duriez | 292/201 |
| 2002/0096889 | A1 | 7/2002 | Nelsen et al. | |
| 2002/0105192 | A1 | 8/2002 | Perkins et al. | |

FOREIGN PATENT DOCUMENTS

| | | |
|---|---|---|
| DE | 196 14 123 | 10/1997 |
| EP | 1 217 156 | 6/2002 |
| EP | 1 281 828 | 2/2003 |
| GB | 2 216 588 | 10/1989 |
| GB | 2 320 943 | 7/1998 |
| WO | WO 01/02677 | 1/2001 |
| WO | WO 03/004810 | 1/2003 |

OTHER PUBLICATIONS

United Kingdom Search Report dated Jul. 22, 2003.
European Search Report dated Jun. 23, 2004.

* cited by examiner

*Primary Examiner*—Gary Estremsky
(74) *Attorney, Agent, or Firm*—Carlson, Gaskey & Olds

(57) ABSTRACT

A latch arrangement includes a latch bolt having a closed position and an open position. An actuator moves a driving abutment to move a detent between an engaged position retaining the latch bolt in the closed position and a release position freeing the latch bolt. A clutch member selectively couples a driving abutment with the detent. When in the latched closed position, the clutch member lies in a first position. The actuator causes the clutch member to selectively couple the driving abutment with the driven abutment to move the latch arrangement to the unlatched closed position, causing the clutch member to follow a first path. Movement of the latch arrangement to the unlatched open position causes the clutch member to follow a second path. Movement of the latch arrangement to the latched closed position causes the clutch member to follow a third path. The first path, the second path and the third path are different.

16 Claims, 8 Drawing Sheets

LATCHED. CLOSED

LATCHED. CLOSED

LATCHED. CLOSED

UNLATCHED. CLOSED

UNLATCHED. OPEN

POWER OPERABLE LATCH THAT RELATCHES IN THE EVENT OF MOTOR FAILURE

REFERENCE TO RELATED APPLICATION

This application claims priority to United Kingdom Patent Application GB 0306671.9 filed on Mar. 22, 2003.

BACKGROUND OF THE INVENTION

The present invention relates generally to latches, and in particular to power unlatching latches used in passenger doors of vehicles.

Power unlatching latches (also known as power release latches) are known. Latches typically include a latch bolt in the form of a rotating claw which is held in a closed position, or a first safety position, by a pawl (also known as a detent). The pawl can be rotated by operation of a door handle to rotate the claw when the door is opened. Various systems are known whereby the pawl can additionally be rotated by an actuator, typically an electric motor.

A drawback to electric motors is that they can fail in service. Sometimes, motor failure occurs when the latch is fully closed, and sometimes motor failure occurs when the latch is fully opened. In the former case, the latch must then be manually opened. Typically, motor failure will be immediately apparent to the user since the handle load will increased. In the latter case, it may not be possible to relatch the door, but again, this is immediately apparent to the user.

Motor failure can also occur partially through an opening sequence. Under these circumstances, it is possible to finish the opening sequence by manual operation of a door handle. It is also possible to properly relatch the latch upon closing of the door. However, while the door may remain closed, the latch mechanism (typically a latch pawl engaging a rotating claw latch bolt) may not be fully engaged, and there is a risk that the door may unexpectedly and suddenly open when the vehicle is in use, creating a safety hazard for the vehicle occupants.

SUMMARY OF THE INVENTION

An object of the present invention is to provide a power operable latch arrangement that is more likely to correctly relatch in the event of motor failure.

According to the present invention, a latch arrangement is provided that includes a power operable actuator arrangement. The power operable actuator includes a drive mechanism and an actuator operable to move a driving abutment of the drive mechanism. The power operable actuator arrangement includes a latch bolt having a closed position and an open position and a detent having an engaged position capable of retaining the latch bolt in the closed position and a release position at which the detent frees the latch bolt for movement from the closed position. The detent includes a driven abutment operable to move the detent from the engaged position to the released position. The drive mechanism includes a clutch member for selectively operably coupling the driving abutment with the driven abutment.

The latch arrangement has a latched closed position, where the latch bolt is in the closed position and the detent is in the engaged position, an unlatched closed position where the latch bolt is in the closed position and the detent is in the released position, and an unlatched open position where the latch bolt is in the open position.

When the latch arrangement is in the latched closed position, the clutch member lies in a first position and powered operation of the actuator causes the clutch member to selectively couple the driving abutment with the driven abutment and move the latch arrangement to the unlatched closed position, causing the clutch member to follow a first path. Subsequent movement of the latch arrangement to the unlatched open position causes the clutch member to follow a second path. Subsequent movement of the latch arrangement to the latched closed position causes the clutch member to follow a third path. The first path, the second path and the third path are different.

When the latch arrangement reaches the unlatched closed position, the actuator has fulfilled its function for the particular opening sequence. Subsequent opening and closing of the door will return the latch arrangement to the latched closed position without the power operating the actuator. By providing one path (the first path) through which the clutch member moves during power operation of the actuator and providing a different path (second and third paths) through which the clutch member moves during the subsequent opening and closing of the door, the clutch member never lies on the first path during the latter part of the opening and closing sequence. Therefore, the driving abutment cannot block the return movement of the clutch member.

BRIEF DESCRIPTION OF THE DRAWINGS

The invention will now be described, by way of example only, with reference to the accompanying drawings in which.

DESCRIPTION OF THE PREFERRED EMBODIMENT

Figure 2:
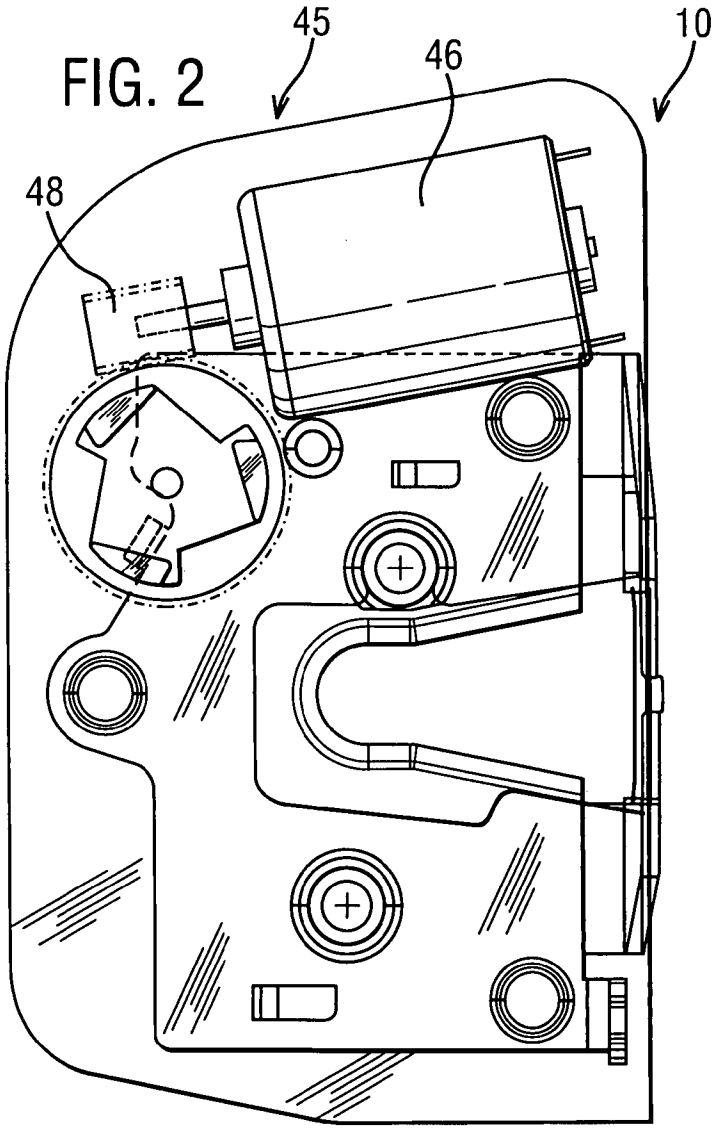
FIG. 2 schematically illustrates a different cross-sectional view of the latch of FIG. 1 showing only certain components for clarity.

With reference to the figures there is shown a latch arrangement 10 mounted on a vehicle door (not shown). The latch includes a chassis 12 upon which various components are mounted.

A latch bolt in the form of a rotating claw 14 is pivotally mounted on the chassis 12 at a pivot 16. The claw 14 is biased in a counter-clockwise direction when viewing FIG. 1 by a spring 18 (shown schematically) which reacts against a pin 20 of the chassis 12. The claw 14 has a periphery 36 which varies in radius from the pivot 16. One portion of the claw 14 has a radius R1, and another portion of the claw 14 has a radius R2, which is less than R1.

Figure 1:
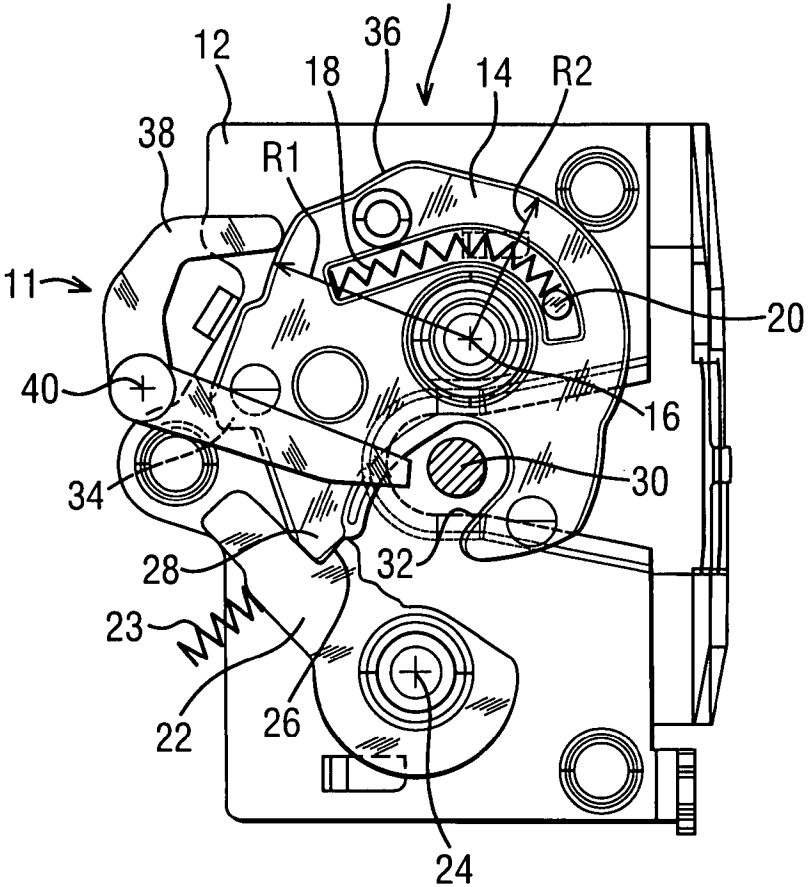
FIG. 1 schematically illustrates a cross-sectional view of a latch according to the present invention.

A pawl (also known as a detent) 22 is pivotally mounted to the chassis 12 at a pivot 24. The pawl 22 includes a pawl abutment 26 engageable with a corresponding closed claw abutment 28 of the claw 14 to hold the claw 14 in the fully closed position as shown in FIG. 1. The pawl abutment 26 can additionally contact a claw abutment 34 of the claw 14 to hold the claw 14, and hence the door, in a first safety position whereby the door is not fully closed, but nevertheless will not open. The pawl 22 is biased in a clockwise direction when viewing FIG. 1 by a spring 23 (shown schematically). A striker 30 mounted on another fixed structure of the vehicle, such as a B-post or a C-post (not shown), is retained within the mouth 32 of the claw 14 to keep the door in a closed position.

Figure 13:
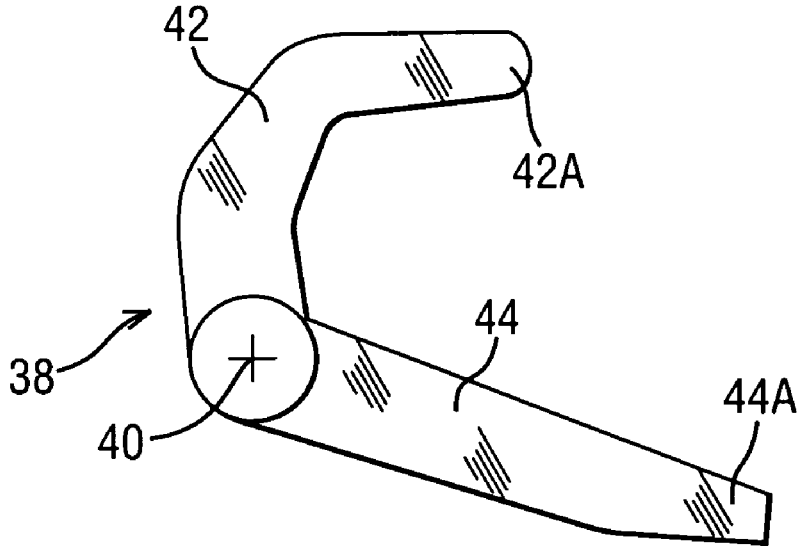
FIG. 13 shows various components of the latch in isolation.

The latch arrangement 10 also includes an ajar lever 38 (shown in FIG. 13) pivotally mounted to the chassis 12 at a pivot 40 having a first arm 42 and a second arm 44. An end 42A of the first arm 42 engages the periphery 36 of the claw 14. An end 44A of the second arm 44 engages part of a clutch link 80, further described below. The ajar lever 38 is biased in a clockwise direction when viewing FIG. 1 by a spring (not shown).

A power actuator arrangement 45 includes a power actuator in the form of an electric motor 46 mounted on the chassis 12 and operable to rotate a worm gear 48. The power actuator arrangement 45 also includes a drive mechanism 11 which operates to allow the motor 46 to unlatch the latch arrangement 10. The drive mechanism 11 allows the latch arrangement 10 to be fully returned to a fully latched condition in the event of motor failure.

Figure 5:
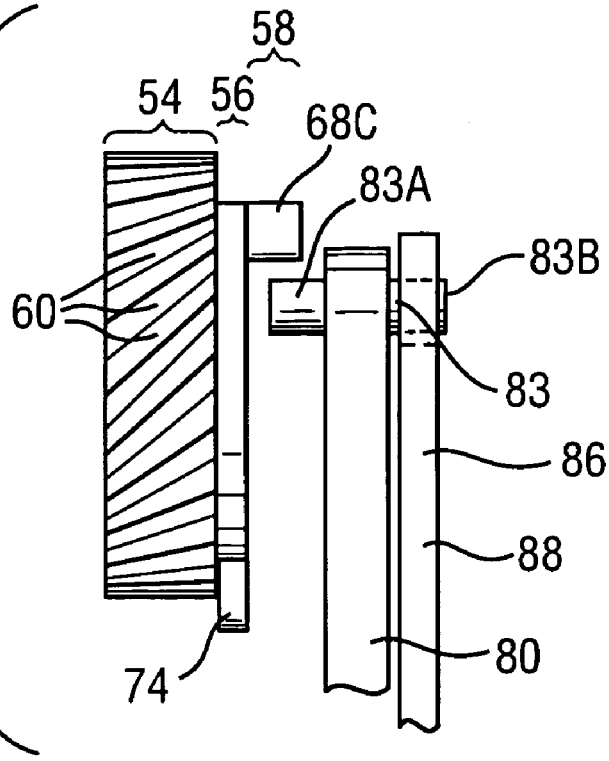
FIG. 5 schematically illustrates a view taken in the direction of arrow A of FIG. 4 showing only certain components.
Figure 12:
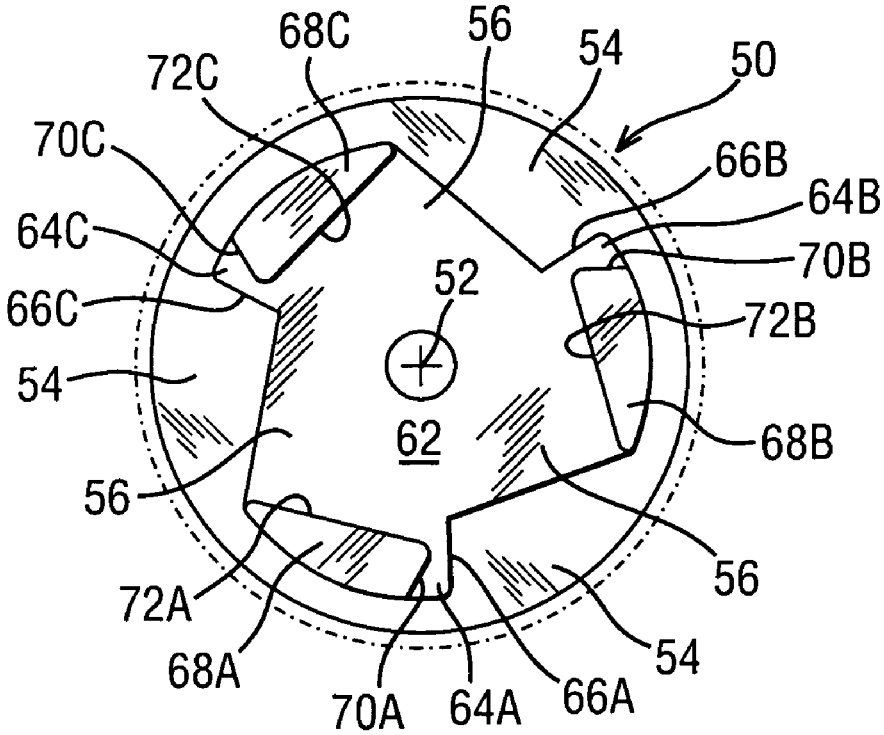
FIG. 12 shows various components of the latch in isolation.

A worm wheel 50 (shown in FIGS. 5 and 12) is rotatably mounted on the chassis 12 at a pivot 52. As shown in FIG. 5, the worm wheel 50 is divided into three regions. The first region 54 includes teeth 60 that mesh with the worm gear 48. Actuation of the motor 46 rotates the worm wheel 50 in a counter-clockwise direction when viewing FIG. 2.

The second region 56 of the worm wheel 50 is in the form of a boss 62 and has three circumferentially equispaced arms 64A, 64B, 64C each including a corresponding abutment 66A, 66B, 66C (also known as first abutments).

The third region 58 of the worm wheel 50 consists of three discrete equispaced bosses 68A, 68B, 68C (only one is shown in FIG. 5 for clarity). Each discrete boss 68A, 68B, 68C includes a circumferentially orientated abutment 70A, 70B, 70C (also known as driving abutments) and a radially inwardly orientated abutment 72A, 72B, 72C.

Figure 11:
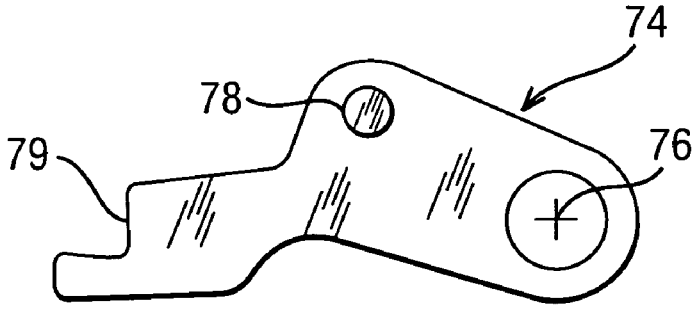
FIG. 11 shows various components of the latch in isolation.

A stop lever 74 (shown in FIGS. 3, 5 and 11) is pivotally mounted at a pivot 76 to the chassis 12 and includes an upstanding pin 78 and a stop abutment 79 that engages the abutments 66A, 66B, 66C of the second region 56 of the worm wheel 50 as described below.

Figure 15:
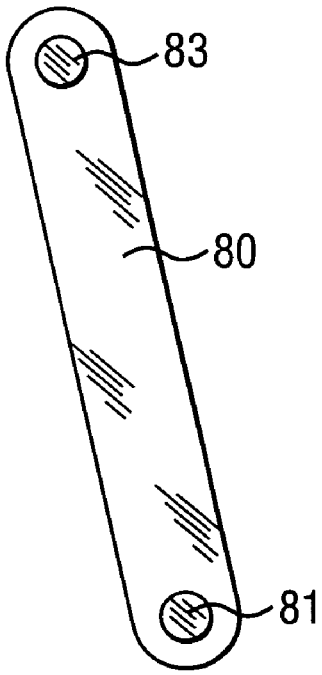
FIG. 15 shows various components of the latch in isolation.

A clutch link 80 (shown in FIGS. 5 and 15) is generally elongate and includes a pivot pin 81 at a lower end. The pivot pin 81 mounts in an elongate slot 82 of the chassis 12 and is biased to a central position of the elongate slot 82 by springs (not shown). As shown in FIG. 5, a further clutch pin 83 (also known as a clutch member) at an upper end of the clutch link 80 projects from both sides of the clutch link 80. An end 83A of the clutch pin 83 can engage the abutments 70A, 70B, 70C or 72A, 72B, 72C, as described below. An end 83B of the clutch pin 83 engages in the slot 89 of an unlatching lever 86, as described below. The clutch pin 83 (clutch member) includes the link portion (a clutch link 80) which, as described below, selectively couples the worm wheel 50 to the unlatching lever 86.

Figure 14:
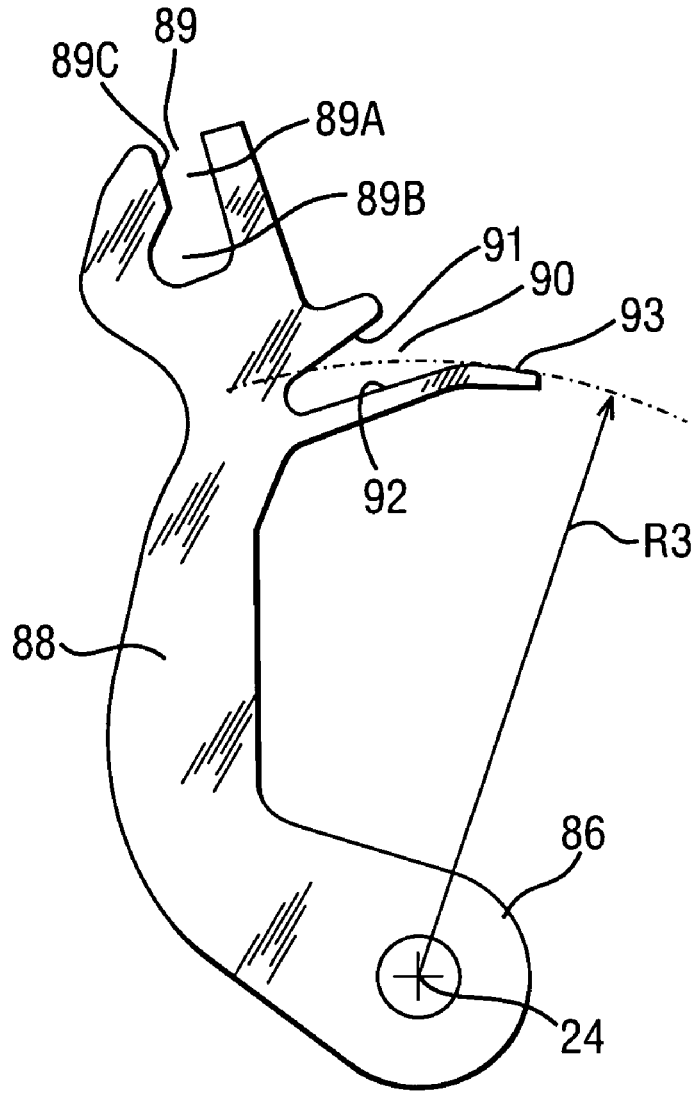
FIG. 14 shows various components of the latch in isolation.

The unlatching lever 86 (shown in FIGS. 5 and 14, also known as a release lever or a pawl lifter) is pivotally mounted via a pivot 24 onto the chassis 12. The unlatching lever 86 includes a major arm 88 at the end remote from the pivot 24 having two slots 89 and 90. The slot 89 receives the end 83B of the clutch pin 83 of the clutch link 80, as further described below. The slot 89 includes a narrow portion 89A including an edge 89C (also known as a driven abutment) and a wider portion 89B. The slot 90 is defined on one side by a surface 91 and on the other side by surfaces 92 and 93. The surface 93 is defined as an arc of radius R3 struck about the axis of the pivot 24. The surface 92 slopes relative to the surface 93 and is closer to the pivot 24 than the surface 93. The unlatching lever 86 is fixed for rotation with the pawl 22 and is therefore biased in a clockwise direction by the spring 23.

Figure 10:
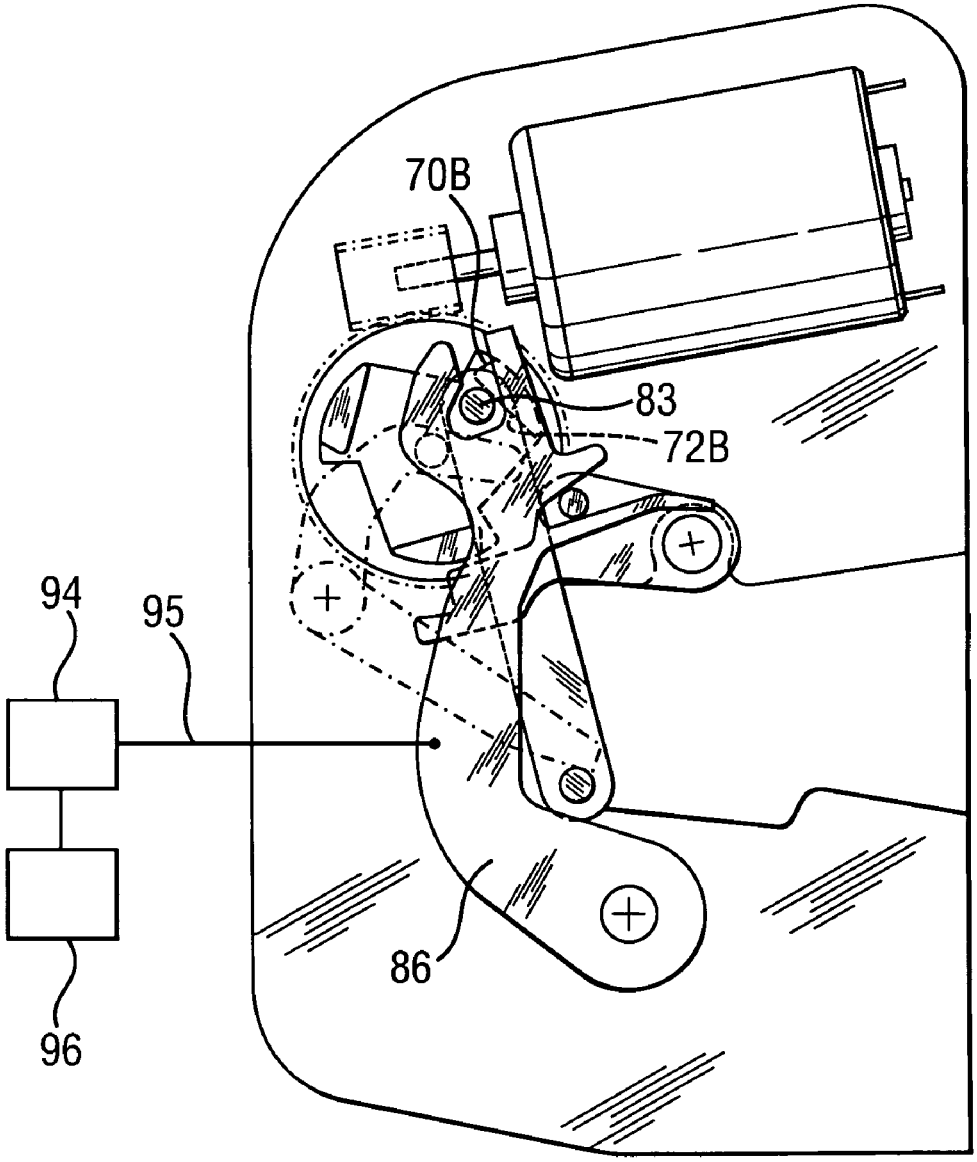
FIG. 10 shows the components of the latch in the position where power unlatching has failed partially through the sequence.

FIG. 10 schematically illustrates a manually actuable element in the form of a door handle 94 connected via a mechanical transmission path 95 (shown schematically) to the unlatching lever 86. In the event of power failure to the motor 46, operation of the door handle 94 moves the unlatching lever 86 counter-clockwise about the pivot 24 to move the detent 16 to release the latch arrangement 10. The door handle 94 includes a sensor 96 that detects an initial movement of the door handle 94, thereby detecting an unlatching requirement.

Figure 4:
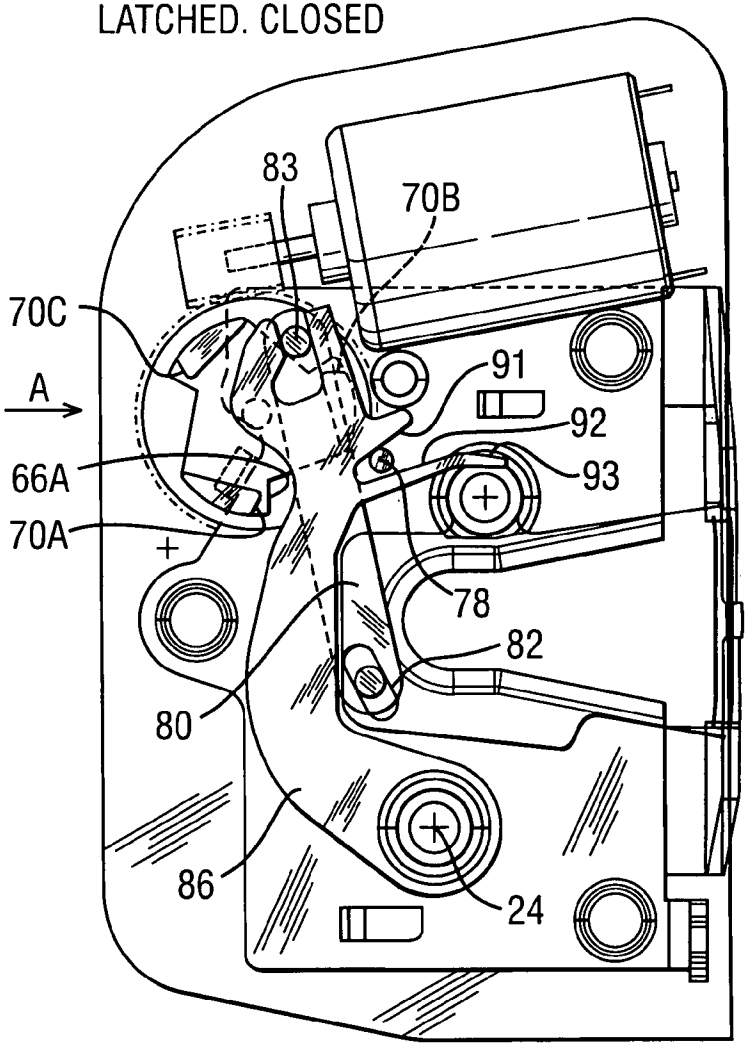
FIG. 4 schematically illustrates a cross-sectional view as per FIG. 2 with various components shown in a latched closed condition.

FIGS. 1 and 4 illustrate the latch arrangement 10 in a latched closed position whereby the striker 30 is retained in the mouth 32 of the claw 14. The claw 14 is held in the position shown in FIG. 1 by the pawl 22. The end 42A of the ajar lever 38 is positioned at radius R1 from the pivot 16. The ajar lever 38 is positioned in its most counter-clockwise position, and the end 44A of the second arm 44 is positioned in its most raised position. The unlatching lever 86 is biased in a clockwise direction by the associated spring 23 to align the pawl abutment 26 of the pawl 22 with the claw abutment 28 of the claw 14. With the latch arrangement 10 in the latched closed position, the position of the unlatching lever 86 dictates the position of the end 83B of the clutch pin 83 of the clutch link 80. This is because the end 83B is positioned within the slot 89 of the unlatching lever 86. Thus, the clutch pin 83 is positioned as shown in FIG. 4, and the end 83A of the clutch pin 83 lies in the path of the circumferentially orientated abutment 70B when the worm wheel 50 is rotated in a counter-clockwise direction, as described below. The longitudinal position of the clutch link 80 is dictated by the biasing of the pivot pin 81 to the central position of the slot 82 by the springs (not shown).

The surface 91 of the slot 90 of the unlatching lever 86 contacts the pin 78 of the stop lever 74 and forces it downwardly to the position shown in FIG. 4, such that the stop lever 74 moves to its most counter-clockwise position and the stop abutment 79 is positioned below the abutment 66A (see the position of the stop lever 74 relative to the worm wheel 50 in FIG. 9). Thus, the stop lever 74 does not prevent rotation of the worm wheel 50.

When the latch arrangement 10 is to be opened electrically, the vehicle user generates an opening signal, either by operating a remote control device (not shown) or by an initial movement of an inside or outside door handle 94, creating a signal from a sensor 96. When the opening signal is generated, power is fed to the motor to rotate the worm wheel 50 about 120° in a counter-clockwise direction to the unlatched closed position shown in FIG. 6. The abutment 70B will move into engagement with the end 83A of the clutch pin 83 and will therefore drive the clutch pin 83 to the position shown in FIG. 6. The abutment 70B (and in particular its angle and width), the slot 82, and the biasing of the pivot pin 81 within the slot 82 are arranged such that the pin 83A remains in engagement and is driven by the abutment 70B throughout the 120° rotational movement of the worm wheel 50.

Figure 6:
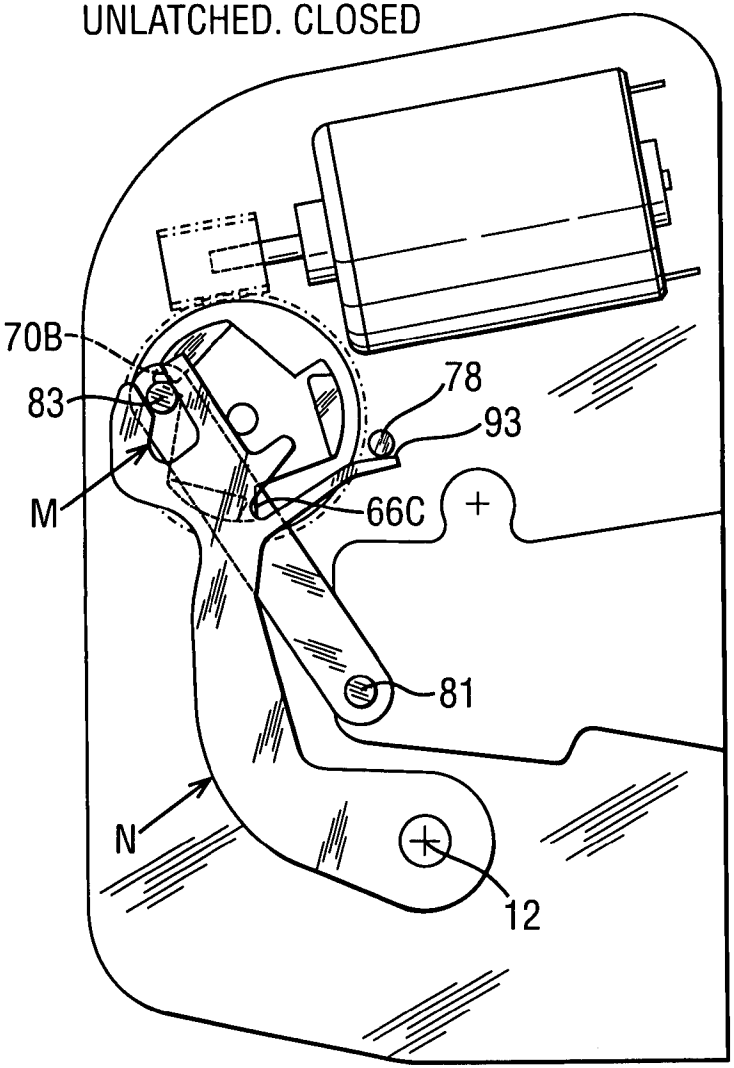
FIG. 6 shows an event occurring during powered unlatching.

As the pin 83 moves from the position shown in FIG. 4 to the position in FIG. 6, the end 83B dictates the position of the slot 89, and hence causes the unlatching lever 86 to rotate in a counter-clockwise direction to the position shown in FIG. 6.

Because the unlatching lever 86 is coupled to the pawl 22, the pawl 22 also rotates in a counter-clockwise direction such that the pawl abutment 26 of the pawl 22 disengages from the claw abutment 28 of the claw 14, thereby freeing the claw 14 for counter-clockwise rotation, unlatching the latch arrangement 10 and freeing the striker 30 from the mouth 32.

Figure 3:
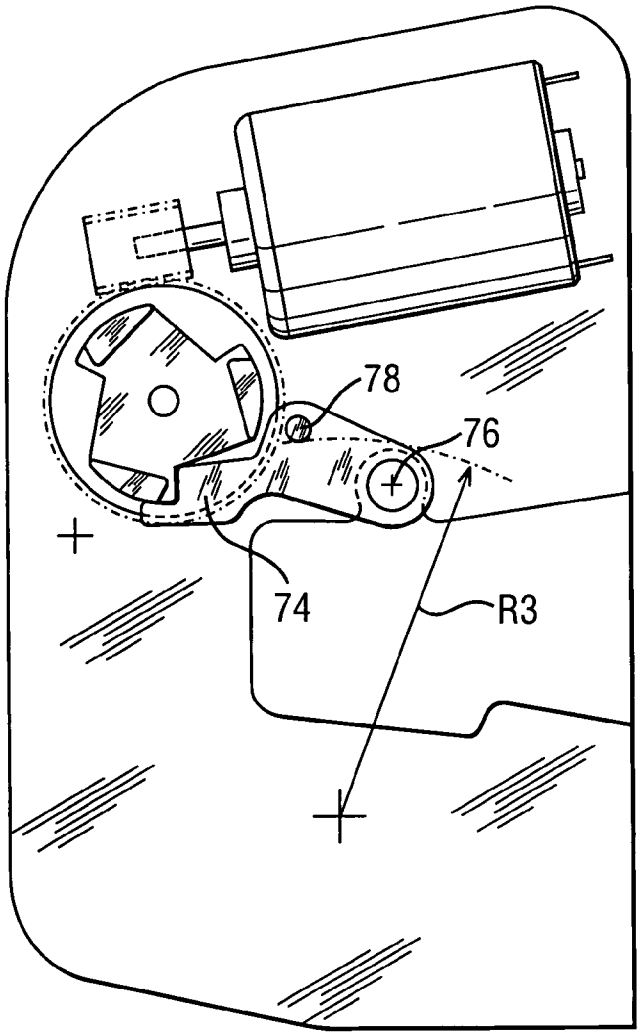
FIG. 3 schematically illustrates an equivalent cross-sectional view to FIG. 2 showing only certain components.

As the unlatching lever 86 moves in a counter-clockwise direction, the surface 92 moves generally leftward underneath the pin 78, when viewing FIG. 4. By virtue of its angled surface, the surface 92 causes the pin 78 to be pushed (cammed) generally upwardly until the pin 78 contacts the surface 93, and the pin 78 is positioned at radius R3 from the pivot 24. As shown in FIG. 3, the radius R3 has been superimposed on this figure to show that as the pin 78 moves generally upwardly, the stop lever 74 rotates clockwise about the pivot 76, resulting in the stop abutment 79 being positioned in the path of the abutment 66C. Once the abutment 66C contacts the stop abutment 79, the worm wheel 50 is prevented from further rotation, the motor 46 will momentarily stall, and the control system (not shown) controlling the motor 46 will cut power to the motor 46. Depending on the particular application, the motor 46 will be powered for a fixed duration of typically between 0.1 and 0.5 seconds. The time is just longer than the time it takes for the worm wheel 50 to rotate through about 120° under normal operating conditions.

Figure 7:
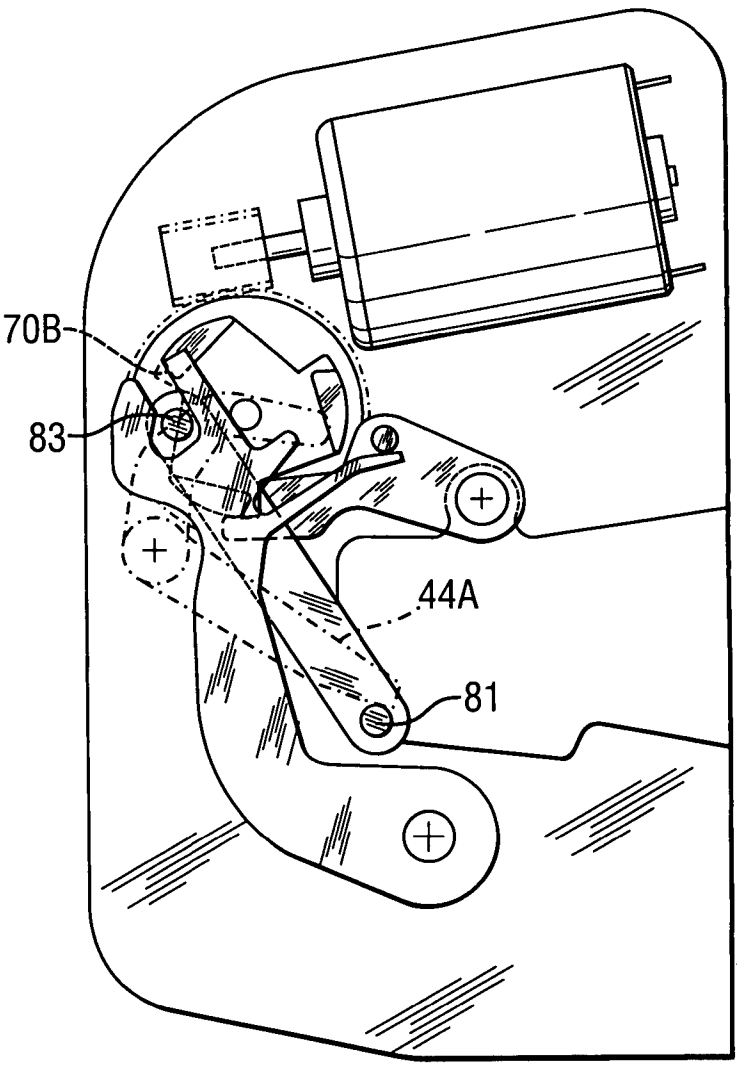
FIG. 7 shows another event occurring during powered unlatching.
Figure 8:
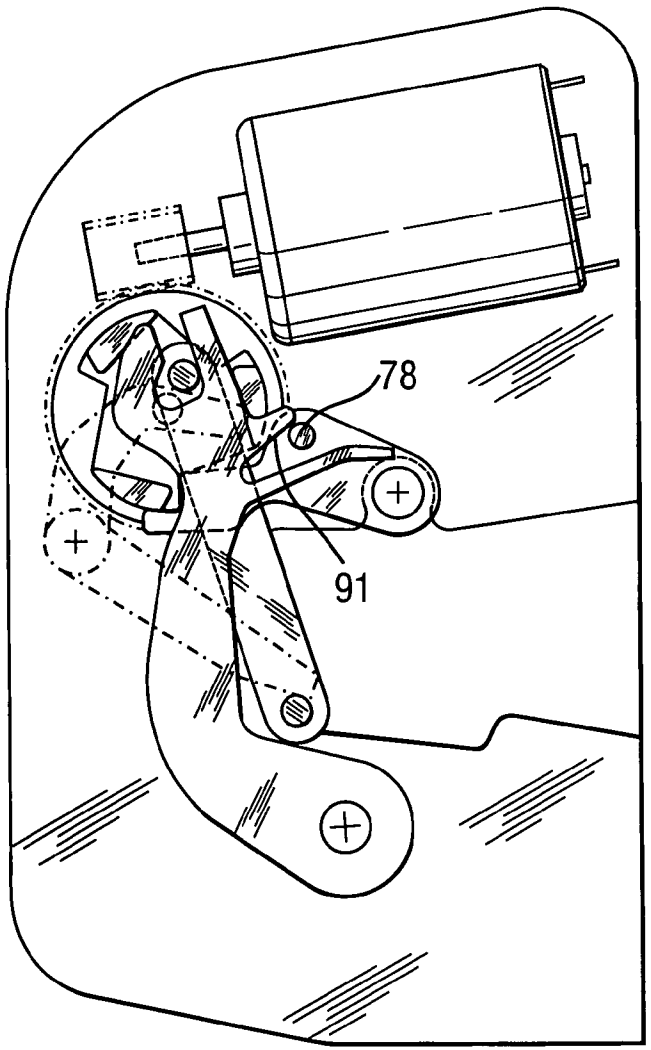
FIG. 8 shows another event occurring during powered unlatching.

The full unlatching sequence is shown in FIGS. 4, 6, 7, 8 and 9. The positions shown in FIGS. 6, 7 and 8 are only momentarily achieved as part of the unlatching sequence.

As shown in FIG. 6, the pawl abutment 26 has been disengaged from the claw abutment 28, and rotation of the worm wheel 50 stops by virtue of the stop lever 74, but the claw 14 has not yet started to rotate (the pivot pin 81 is still located in the narrow portion 89A of the slot 89). The claw 14 and the ajar lever 38 are still in the position shown in FIG. 1, and the latch arrangement 10 is in the unlatched closed position. The clutch pin 83 has acted as a clutch member and has selectively coupled the abutment 70B (a driving abutment) of the drive mechanism 11 with the edge 89C (a driven abutment) of the slot 89 of the unlatching lever 86, and therefore the pawl 22 (since the unlatching lever 86 is rotationally fast with the pawl 22). The path traversed by the clutch pin 83 when moving from FIG. 1 to FIG. 6 is generally arcuate and centred on the axis of the worm wheel 50. This path is known as a first path 1, shown in FIG. 16.

Once the claw 14 starts to rotate in a counter-clockwise direction, the periphery 36 will pass under the end 42A of the ajar lever 38 such that the region at radius R1 moves away from the end 42A, and the region at radius R2 is moved under the end 42A, allowing the end 42A to move from radius R1 to radius R2, i.e. towards the pivot 16 and resulting in the ajar lever 38 rotating in a clockwise direction. The end 44A of the second arm 44 of the ajar lever 38 moves generally downwardly to contact and then move the pivot pin 81 generally downwardly within the slot 82 to the position shown in FIG. 7. The generally downwardly movement of the pivot pin 81 causes a similar generally downwardly movement of the clutch pin 83, which disengages the end 83A from the circumferentially oriented abutment 70B and disengages the end 83B from the edge 89C. The end 83B thus moves from the narrow portion 89A to the wide portion 89B of the slot 89. As shown in FIG. 7, the clutch pin 83 is now free to move to the right (though it has not yet done so). Thus, the ajar lever 38 in conjunction with the clutch link 80 act to disengage the clutch pin 83 from the abutment 70B.

Because the unlatching lever 86 is biased in a clockwise direction by the spring 23, it pushes the clutch pin 83 to the right. FIG. 8 shows the clutch pin 83 moving to the right (under the action of the spring 23), and FIG. 9 shows the clutch pin 83 in its fully unlatched open position. Note that in both FIGS. 8 and 9, the clutch pin 83 is in the wide portion 89B of the slot 89.

In moving from the FIG. 6 position to the FIG. 7 position, the abutment 70B (a driving abutment) selectively decouples from the edge 89C (a driven abutment). This is because the end 83A no longer contacts the abutment 70B, and the end 83B is in the wide portion 89B of the slot 89 and is disengaged from the edge 89C of the narrow portion 89A. The path of movement of the clutch pin 83 when moving from the FIG. 5 position to the FIG. 9 position is generally chordal relative to the first path. This generally chordal path is known as a second path 2.

Figure 9:
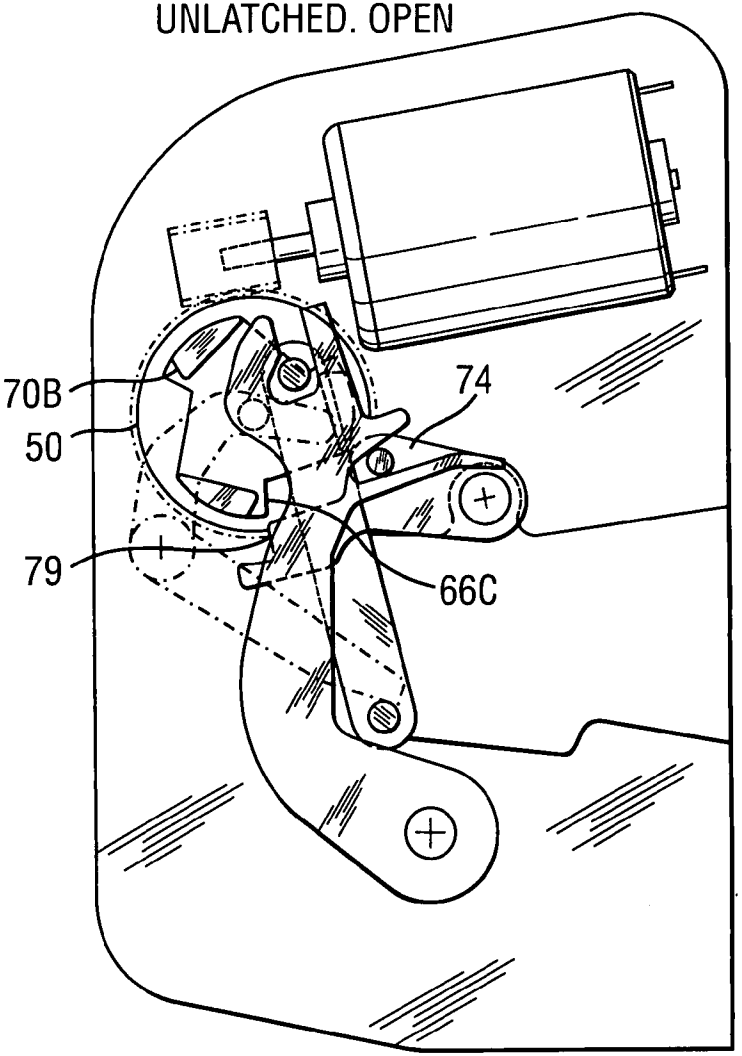
FIG. 9 shows another event occurring during powered unlatching.

As shown in FIG. 9, the unlatching lever 86 and the associated pawl 22 are now in a position whereby subsequent slamming of the door causes the claw 14 to rotate to the closed position and be held in the closed position by the pawl 22. As the unlatching lever 86 is rotated clockwise, the surface 91 approaches (FIG. 8) and then contacts and forces downwardly (FIG. 9) the pin 78, causing the stop lever 74 to rotate in a counter-clockwise direction about the pivot 76 to free the stop abutment 79 from the abutment 66C.

When the door is slammed shut, the ajar lever 38 rotates counter-clockwise to the position shown in FIG. 1, causing the end 44A to move generally upwardly to allow the clutch link 80, and hence the clutch pin 83, to also move generally upwardly to the position shown in FIG. 4. The generally linear path traversed by the clutch pin 83 when moving from the FIG. 9 position to the FIG. 4 position is known as a third path 3.

During the subsequent slamming of the door, the worm wheel 50 and the stop lever 74 will not move. As the claw 14 rotates to the closed position, the pawl abutment 26 will initially ride over the claw abutment 34 of the claw 14, causing the pawl 22 and the unlatching lever 86 to momentarily rotate clockwise and counter-clockwise. The momentary clockwise and counter-clockwise rotation will be repeated as the pawl abutment 26 rides over the claw abutment 28 of the claw 14.

Typically, the control system controlling the motor will be timed to cut the power to the motor at some time between position shown in FIG. 6 and the position shown in FIG. 9.

An open and closing sequence will cause the worm wheel 50 to index through about 120° in this example. Thus, starting at the position shown in FIG. 1, an opening signal generated by the initial movement of the inside or outside door handle 94 (as described above) will not result in power opening in the event of battery failure of the vehicle. However, continued movement of the inside or outside door handle 94 by the user will result in features (not shown) rotating the pawl 22 in a counter-clockwise direction (under manual power) to the door.

In the event that the motor fails partially through an opening sequence, the latch arrangement 10 can be opened and safely closed. Thus, with reference to FIG. 10, the worm wheel 50 has been rotated through approximately 60° in a counter-clockwise direction where upon the motor has failed.

In view of the fact hat the motor was initially activated by movement of the inside door handle 94 (generating a signal via the sensor 96), the user will continue to move the inside door handle 94 to the open position and expect that the latch arrangement 10 will be powered open. However, in this case, the latch arrangement 10 is not powered open, but the user will continue to move the door handle 94 to the fully open position and manually open the latch arrangement 10 via the mechanical transmission path 95. The user will notice that the force required to move the door handle 94 increases, indicating a malfunction that will require later rectification.

FIG. 10 shows the latch arrangement 10 in a fully unlatched condition. When compared to FIG. 9, the differing positions of the circumferentially orientated abutment 70B indicate that the worm wheel 50 shown in FIG. 10 has not rotated as far as the worm wheel 50 shown in FIG. 9. In both cases, the latch arrangement 10 is fully open and hence the ajar lever 38 is in the same position. Since the end 44A of the second arm 44 of the ajar lever 38 abuts the pivot pin 81, then the clutch link 80 is in a lowered position in both cases and hence the end 83B sits in the wide portion 89B.

FIG. 10 shows that the end 83A of the clutch pin 83 is biased into the abutment with the radially inwardly orientated abutment 72B. Because the clutch pin 83 is located in the wide portion 89B of the slot 89, the unlatching lever 86 can move to the fully clockwise position, and the pawl 22 can move to the fully clockwise position.

Because the unlatching lever 86 is in the same position in FIGS. 10 and 9, the pin 78 is forced downwardly to the same position in both figures by the surface 91, and hence the stop lever 74 is also in the same position when considering FIGS. 9 and 10.

The position of the clutch pin 83 as shown in FIG. 10 (motor failure condition) lies at the position where the second and third paths meet (i.e., it lies on the second path 2 and the third path 3). If the motor fails in a slightly different position, the clutch pin 83 could lie on just the second path 2, it could lie on just the third path 3, it could lie proximate to either the second path 2 or the third path 3.

Figure 16:
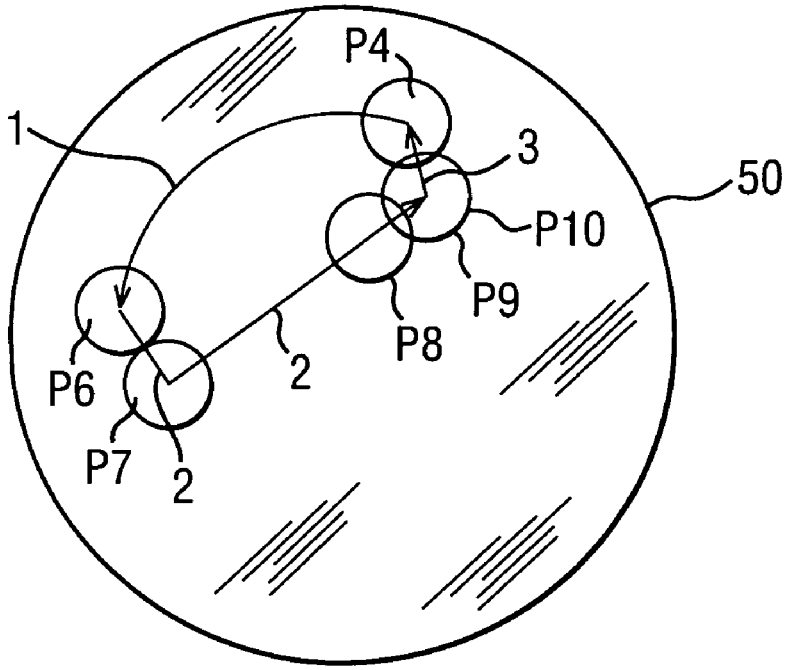
FIG. 16 is a composite view of certain components of the latch.

FIG. 16 shows the relative positions P4, P6, P7, P8, P9 and P10 of the clutch pin 83 in FIGS. 4, 6, 7, 8, 9 and 10, respectively, superimposed on the worm wheel 50. FIG. 16 also shows the first path 1, second path 2 and the third path 3.

The present invention provides for a latch arrangement 10 which, if the motor does not complete an unlatching sequence and the latch is opened manually, the unlatching lever 86 will nevertheless always return fully to its rest position ensuring full engagement between the pawl abutment 26 and the claw abutment 28 or 34 depending upon whether the door is fully closed or in a first safety position. A pawl 22 which is only partially engaged with the corresponding claw abutment 28 or 34 of the claw 14 provides a safety hazard, since a user would believe the door to be properly closed, but because of only partial engagement between the pawl 22 and the claw 14, there is a danger that the pawl 22 can disengage from the claw 14 and allow the door to unexpectedly open.

For power unlatching, the motor is only required to be turned (i.e., driven) in one direction, simplifying the control system and wiring to the motor.

The motor is powered for predetermined pulsed periods following an opening requirement signal. Additionally, or alternatively, the power to the motor can be cut following a predetermined event. Thus, a sensor or micro switch could be used to detect each 120° rotation of the worm wheel 50. Typically, an appropriate cam formation could be included on the worm wheel 50 for use in conjunction with a micro switch.

Alternatively, a micro switch could be used (e.g., positioned at arrow M FIG. 6) to detect when the top of the clutch link 80 has just moved to the position shown in FIG. 6. In another embodiment, a micro switch could be positioned (e.g., at N FIG. 6) to detect an initial movement of the unlatching lever 86 as it starts to move from the position shown in FIG. 6 to the position shown in FIG. 7.

Whilst the embodiments shown in the figures have three driving abutments 70A, 70B and 70C, further embodiments could include more or fewer driving abutments. For example, it is possible to have a single driving abutment. For example, FIG. 4 shows that in a latched closed condition it is only necessary to provide the abutment 73. The abutments 70A and 70B together with the corresponding discreet bosses 86A and 86B could be deleted. Under the circumstances, the motor will be powered to rotate the worm wheel through 360° for each opening sequence.

The foregoing description is only exemplary of the principles of the invention. Many modifications and variations of the present invention are possible in light of the above teachings. The preferred embodiments of this invention have been disclosed, however, so that one of ordinary skill in the art would recognize that certain modifications would come within the scope of this invention. It is, therefore, to be understood that within the scope of the appended claims, the invention may be practiced otherwise than as specifically described. For that reason the following claims should be studied to determine the true scope and content of this invention.

What is claimed:

1. A latch arrangement comprising:

a latch bolt having a closed position and an open position;

a detent having an engaged position capable of retaining the latch bolt in the closed position, a release position at which the latch bolt can move from the closed position and a relatchable position at which movement of the latch bolt to the closed position allows the detent to move to the engaged position;

a drive mechanism having a driving abutment rotatable about an axis;

a clutch member having a clutch member abutment for selective engagement with the driving abutment, wherein the clutch member selectively operably couples the driving abutment with the detent by selective engagement of the clutch member abutment with the driving abutment; and an actuator operable to move the driving abutment;

the latch arrangement having a latched closed position wherein the latch bolt is in the closed position, the detent is in the engaged position, and the clutch member abutment is in a first position, an unlatched closed position wherein the latch bolt is in the closed position, the detent is in the released position, and the clutch member abutment is in a second position, and an unlatched open position wherein the latch bolt is in the open position, the detent is in the relatchable position, and the clutch member abutment is in a third position; and wherein, starting from the latch closed position, powered operation of the actuator causes the driving abutment to engage the clutch member with abutment and the clutch member abutment to engage the detent to cause the clutch member abutment to follow a first arcuate path centered on the axis and to cause the detent to move to the unlatched closed position, subsequent movement of the latch arrangement to the unlatched open position causes the clutch member abutment to follow a second path, and subsequent movement of the latch arrangement to the latched closed position causes the clutch member abutment to follow a third path; and wherein the first path, the second path and the third path are different.

2. The latch arrangement as defined in claim 1 wherein the latch arrangement is manually moveable to the unlatched open position if the actuator fails during opening, and the latch arrangement is subsequently moved to the latched closed position while the clutch member lies remote from the first position and proximate to one of the second path and the third path.

3. The latch arrangement as defined in claim 1 wherein the second path is generally chordal relative to the first path.

4. The latch arrangement as defined in claim 1 wherein the third path is generally linear.

5. The latch arrangement as defined in claim 1 wherein the drive mechanism further includes a plurality of driving abutments.

6. The latch arrangement as defined in claim 1 wherein the driving abutment is mounted on a worm wheel.

7. The latch arrangement as defined in claim 6 wherein the drive mechanism includes a stop lever and the worm wheel includes a first abutment surface, and the stop lever acts on the first abutment surface of the worm wheel to selectively prevent rotation of the worm wheel.

8. The latch arrangement as defined in claim 1 further including a chassis and wherein the clutch member includes a link portion pivotable relative to the chassis via a pivot having a pivot axis.

9. The latch arrangement as defined in claim 8 wherein the pivot axis is translatable relative to the chassis.

10. The latch arrangement as defined in claim 9 wherein the pivot axis is translatable along a total distance, and the pivot axis is biased to a mid-position of the total distance when the latch arrangement is in the latch closed position.

11. The latch arrangement as defined in claim 1 further including an ajar lever operable to detect the open position and the closed position of the latch bolt.

12. The latch arrangement as defined in claim 11 wherein the ajar lever moves the clutch member to selectively decouple the driving abutment from the detent when the latch bolt moves to the open position.

13. The latch arrangement as defined in claim 11 wherein the ajar lever returns the latch arrangement to the latched closed position upon closing the latch bolt.

14. The latch arrangement as defined in claim 7 further including an unlatching lever fixed for rotation with the detent that selectively disengages the stop lever and allows subsequent actuation of the actuator as the latch bolt moves to the closed position.

15. The latch arrangement as defined in claim 14 wherein the unlatching lever selectively engages the stop lever to limit subsequent actuation of the actuator as the latch bolt moves to the open position.

16. The latch arrangement as recited in claim 1 wherein the first path, the second path and the third path do not overlap.

* * * * *